United States Patent [19]

Schwuger

[11] 3,954,642

[45] May 4, 1976

[54] IMPREGNATED TEXTILE FIBROUS STRUCTURES FOR CLEANING PURPOSES

[75] Inventor: Milan Johann Schwuger, Monheim, Germany

[73] Assignee: Henkel & Cie GmbH, Dusseldorf, Germany

[22] Filed: Nov. 23, 1973

[21] Appl. No.: 418,725

[30] Foreign Application Priority Data

Dec. 2, 1972 Germany ..... 2259137

[52] U.S. Cl. ..... 252/91; 15/104.93; 401/201

[51] Int. Cl.[2] ..... C11D 17/00

[58] Field of Search ..... 252/91, 90, DIG. 15; 15/104.93, 104.94; 401/201; 8/137

[56] References Cited

UNITED STATES PATENTS

| | | | |
|---|---|---|---|
| 2,994,665 | 8/1961 | Reich et al. | 252/DIG. 15 |
| 3,075,228 | 1/1963 | Elias | 252/91 |
| 3,567,118 | 3/1971 | Shepherd et al. | 252/91 |
| 3,597,148 | 8/1971 | Carroll et al. | 8/137 |
| 3,598,742 | 8/1971 | Jamison et al. | 252/91 |
| 3,721,627 | 3/1973 | Adams et al. | 252/DIG. 15 |

*Primary Examiner*—William E. Schulz
*Attorney, Agent, or Firm*—Hammond & Littell

[57] ABSTRACT

The invention relates to textile fibrous structures suitable for cleaning purposes and impregnated with surface-active agents, in which the textile fibrous structures are built up from water-insoluble high polymers with a content of carboxyl groups able to form salts, which are present substantially as free carboxyl groups, and the impregnation consists of at least one non-ionic surface-active agent from the group of water-soluble alkylene oxide derivatives, the turbidity or cloud point of which lies above 20°C, as well as the method of production.

19 Claims, No Drawings

IMPREGNATED TEXTILE FIBROUS STRUCTURES FOR CLEANING PURPOSES

THE PRIOR ART

Cleaning agents in the form of fiber fleeces or non-woven mats, cloths and sponges which are saturated or impregnated with surface-active agents or with inorganic cleaning salts are known. However, the known means have a number of disadvantages. For example, the usual nonionic and anionic surface-active agents are only incompletely adsorbed by the textile materials used for the production of the fibrous structures, irrespective of whether they consist of natural, partly or completely synthetic fibers; but instead they are held on the material primarily by capillary binding forces. Because of the low binding power, such a prior art cleaning cloth when first put into use loses relatively large amounts of the surface-active substance. On continued use, especially on additional use of water, therefore, a reduction of the active substance takes place very rapidly, which is combined with a considerable decline in cleaning power. This loss applies to a still greater extent to inorganic cleaning salts and organic sequestering agents for binding calcium salts, which are very easily detached from the cleaning cloth. For this reason, cleaned and polished surfaces, to which previously unused or only slightly used cleaning cloths have been applied, frequently have a streaked appearance caused by deposited cleaning agent, especially when inorganic cleaning salts are present. The surfaces must therefore, in addition, usually be wiped off or repolished again. Moreover, even a relatively small amount of active substance causes the cloths and sponges to feel unpleasantly greasy and causes the surfaces treated to be smeared with cleaning agent. Apart from this, when strongly charged with cleaning agents, the cloths lose the ability themselves to take up and absorb dirt.

OBJECTS OF THE INVENTION

It is an object of the present invention to provide a textile fibrous structure impregnated with a nonionic surface-active agent and suitable for cleaning purposes comprising a textile structure made from water-insoluble high polymers having a content of salt-forming carboxyl groups in such an amount that there is at least 1 mVal of said salt-forming carboxyl groups per gram of said structure, and said carboxyl groups being present substantially as free carboxyl groups, said structure containing an impregnant comprising at least one water-soluble nonionic polyalkoxylated surface active agent; the turbidity point of said nonionic polyalkoxylated surface-active agent being above 20°C; and said impregnant comprising from 0.05 to 20% by weight of said structure.

It is another object of the present invention to provide a process for the impregnation of the above-described textile fibrous structure.

It is a further object of the present invention to provide an improvement in the process of cleaning or polishing a surface by utilizing a cleaning cloth, wherein the improvement comprises using the above-described textile fibrous structure, as said cleaning cloth.

These and other objects of the invention will become apparent as the description thereof proceeds.

DESCRIPTION OF THE INVENTION

The invention relates to textile fibrous structures suitable for cleaning purposes and impregnated with surface-active agents, in which the textile fibrous structures are built up from water-insoluble high polymers with a content of carboxyl groups able to form salts, which are present substantially as free carboxyl groups, and the impregnant consists of at least one non-ionic surface-active agent from the group of water-soluble alkylene oxide derivatives, the turbidity or cloud point of which lies above 20°C.

The present invention is more particularly directed to a textile fibrous structure impregnant with a nonionic surface-active agent and suitable for cleaning purposes comprising a textile fibrous structure made from water-insoluble high polymers having a content of salt-forming carboxyl groups in such an amount that there is at least 1 mVal of said salt-forming carboxyl groups per gram of said structure, and said carboxyl groups being present substantially as free carboxyl groups; said structure containing an impregnant comprising at least one water-soluble nonionic polyalkoxylated surface-active agent; the turbidity point of said nonionic polyalkoxylated surface-active agent being above 20°C; and said impregnant comprising from 0.05 to 20% by weight of said structure. The impregnation is carried out at a pH of 6 or lower and at a temperature no higher than the turbidity point of said nonionic polyalkoxylated surface-active agent.

The present invention is further directed to a process for the impregnation of the above-described textile fibrous structure comprising contacting a textile fibrous structure containing water-insoluble high polymers with a content of salt-forming carboxyl groups in such an amount that there is at least 1 mVal of said salt-forming carboxyl groups per gram of said structure and which are present substantially as free carboxyl groups, with an aqueous solution containing from 0.1 to 30% by weight of a water-soluble polyalkoxylated non-ionic surface-active agent, the turbidity point of which lies above 20°C, the pH of said solution being 6 or lower for at least 5 minutes at a temperature no higher than the turbidity point, and recovering said impregnated textile fibrous structure.

The present invention is additionally directed to an improvement in the process for cleaning or polishing a surface comprising wiping a surface to be cleaned or polished with a cleaning cloth, wherein the improvement comprises utilizing the impregnated textile fibrous structure described above, as said cleaning cloth.

The textile structutres suitable for the impregnation are obtainable from natural or synthetic high polymers, for example cellulose fibers or vinyl polymers. They preferably should have the largest number of carboxyl groups possible which are capable of forming salts.

The introduction of the carboxyl groups can be effected in a known manner, for example, by carboxymethylation of cellulose, or for example, by graft polymerization of unsaturated carboxylic acids, especially acrylic acid or methacrylic acid, onto cellulose, regenerated cellulose, cellulose esters and/or cellulose ethers. If cellulose derivatives, for example, methyl-ethers, hydroxyalkyl-ethers, or carboxymethyl-ethers, are used for the graft polymerization, the degree of substitution should be so low that the compounds are not water-soluble. The cellulose or its derivatives may be present in the form of fibers, yarns, woven or knitted fabrics, fleeces or non-woven fabrics or sponges, with the fibers and yarns being subsequently converted into the above-mentioned textile structures.

The production of the textile cellulose graft polymers to be used according to the present invention is effected in known way in which acrylic acid or methacrylic acid or their salts, esters or amides or their mixtures, are reacted with the cellulose or its derivatives in the presence of catalysts forming free radicals or in the presence of high energy radiation. If cellulose ethers, especially carboxymethylated cellulose, are used, not more than 0.6 ether groups should be present per anhydroglucose unit in order to avoid water-solubility. The free radical formers suitable for initiating the graft polymerization, besides the use of radiation from a radioactive source, or X-rays or ultraviolet radiation, are especially ions of the transition metals such as Fe, Co, Cr, Mn, V, Ni and Cu, in addition to oxidizing agents, for example periodates, peroxides and peroxyhydrates, such as $H_2O_2$, $H_2S_2O_8$ and benzoyl peroxide, as well as ozone and certain azo-compounds. The use of catalysts which cause a radical formation in the cellulose molecule itself, such as compounds containing tetravalent cerium or trivalent cobalt, is especially advantageous, since their use largely suppresses the formation of homopolymers. High graft yields are also obtained with ions of divalent iron and hydrogen peroxide as a catalyst system, especially when the iron ions are fixed directly onto the cellulose fibers. This may be effected by converting acid groups obtainable by carboxyalkylation, xanthogenation or oxidation of the cellulose into the iron salts.

The monomers can act on the cellulose fibers or the textile structures produced therefrom either undiluted or in admixture with one or more selvents, especially water, as well as organic solvents such as lower alkanols, dimethylformamide, dimethyl sulfoxide or aromatic hydrocarbons. The graft polymerization reaction is generally carried out at elevated temperature, for example at 40° to 80°C; in some cases it is started at lower temperatures. The reaction times range from a few minutes to several hours, depending upon the initiator used.

After termination of the graft polymerization reaction, the fibers or pieces of fabric are freed from the catalyst and from possibly obtained homopolymers by washing with suitable solvents. The polymer chains grafted onto the cellulose, provided free acrylic acid or methacrylic acid or their esters, amides or nitriles have been used as monomers, may be converted by neutralization or saponification of the graft polymers with aqueous alkali metal hydroxides or aqueousalcoholic alkali metal hydroxides, into the alkali metal salts or the ammonium salts. More details of the preparation of such graft polymer production are to be found in the copending, commonly-assigned U.S. patent application Ser. No. 374,338, filed June 28, 1973, now abandoned.

Further suitable starting materials for the textile structures to be used according to the invention are fibers, yarns, woven fabrics, fleeces, prepared from synthetic polymers, especially vinylpolymers. These include the polymers of acrylic acid, methacrylic acid, maleic acid, fumaric acid, itaconic acid, mesanoic acid, citraconic acid, aconitic acid or other unsaturated polycarboxylic acids, their copolymers and the mixed polymers of the said acids with other copolymerizable compounds, such as olefins, vinyl ethers and vinyl esters, also the amides, N-alkylamides, alkoylolamides and nitriles of vinylcarboxylic acids. The copolymers of the above-mentioned unsaturated carboxylic acids with unsaturated compounds containing several double bonds, in which case cross-linked polymers are formed, are of special practical interest. Olefinically polyunsaturated compounds of this kind are, for example, aliphatic, cycloaliphatic and aromatic compounds containing at least two olefinic double bonds, for example butadiene, or divinylbenzene; and also polyolefinically-unsaturated ethers, for example, divinyl ether, diallyl ethers of glycols, and polyolefinically unsaturated esters, for example esters of alkenoic acids such as acrylic acid and methacrylic acid with dihydroxy and polyhydroxy alcohols, such as glycol diacrylate; those from vinyl alcohols or allyl alcohols and polycarboxylic acids, such as divinyl oxalate and divinyl maleate, and also those from unsaturated alcohols with unsaturated acids, such as vinyl acrylate or allyl methacrylate. Diamides may also be used, for example, those from acrylic acid or methacrylic acid and diamines, such as ethyléne-bis-acrylamide. Polymers having at least two polymerizable double bonds, for example, unsaturated polyesters from maleic acid and diols, are also useful.

The copolymerization may be initiated radically, for example by the action of activation radiation, possibly also in the presence of photosensitizers or in the presence of radical-forming catalysts. The polymers may be converted into fibers and these made into fleeces or fabrics. It is more advantageous, however, to conduct the copolymerization so that flat porous fleeces with a large inner surface are immediately formed. A suitable prior art process is taught, for example, in British Patent No. 1,235,146. For this purpose the monomers are dissolved or dispersed in a liquid which solidifies in crystalline form, for example glacial acetic acid or preferably water, whereupon the dispersion or solution is solidified on a cold surface. It is advisable to introduce a carrier before or during the crystallization process, for example a fabric or fibrous fleece of natural or synthetic textile material, so as to give a higher strength to the finished textile structure. The crystallized dispersion is polymerized by means of high intensity radiation, whereupon the dispersing agent or solvent is melted and removed.

A further possibility for the production of carboxyl-group-containing polymers, which may be converted into textile structures, consists in the copolymerization of acrolein with mono- and poly-olefinically unsaturated copolymerizable compounds and subsequent reaction according to Cannizaro. Acrylic acid and methacrylic acid are especially preferable as the mono-olefinically unsaturated copolymerizable compounds, while maleic acid, fumaric acid, itaconic acid, citraconic acid, mesaconic acid and aconitic acid can also be utilized. The copolymerization with polyolefinically unsaturated compounds leads to cross-linked products. Such polyunsaturated compounds include especially the compounds containing at least two olefinic double bonds, ethers and amides, such as are mentioned above. The copolymerization may be started in known manner by means of free-radical-forming catalysts, especially hydrogen peroxide or by high intensity radiation. The copolymers obtained are treated with strong alkaline solutions, when a disproportionation of the formyl groups into hydroxymethyl and carboxylate groups takes place in the proportion of 1:1. This proportion may be improved in favor of a higher fraction of carboxylate groups by use of larger amounts of olefinically unsaturated carboxylic acids in the copolymerization. Suitably utilizable products have a proportion of hydroxymethyl to carboxylate groups in the weight ratio of 1:2 to 1:20 , for example.

The copolymerization may also be carried out in the manner usual for the production of viscose sponge cloths. For this purpose the starting materials are mixed with a multiple of their weight, for example 10 to 50 times, of crystallizable water-soluble salts, especially sodium sulfate decahydrate. The salts are washed out with water after the copolymerization. If desired, textile fibers may be admixed before the copolymerization for the mechanical strengthening of the sponge cloths.

The textile structures, which are prepared according to the above-mentioned process and are impregnated in the manner according to the invention, should have at least 1 mVal (1 milligram equivalent) of carboxy groups capable of salt formation per gram of textile material. The number of carboxyl groups is important both for the adsorptive capacity with respect to the surface active agents to be introduced and for the cleaning power. Since the carboxyl groups are able to bind calcium, magnesium and heavy metal ions, they not only act during the cleaning process as ion exchangers and as softening agents with respect to lime-containing tap water, but also are able to chemically bind mineral contaminations, especially the so-called "lime fog" on the cleaned substrate. Therefore, those substances which are especially suitable are those that contain more than 2 mVal/gm of salt-forming carboxyl groups, for example 3 to 10 mVal/gm. The carboxyl groups should be present mostly in the form of the free acid, and preferably almost completely in the form of the free acid.

According to the invention the textile structures are impregnated with a water-soluble nonionic polyalkoxylated surface active agent. Suitable agents are the water-soluble polyoxyalkylene glycol ether derivatives, where the alkylene has 2 to 4 carbon atoms, primarily polyoxyethylene glycol ethers of primary, preferably straight-chain alcohols of the alkanol, alkenol and alkadienol series having 10 to 24 carbon atoms, especially having 12 to 20 carbon atoms, as well as of preferably linear alkylphenols having 6 to 15 carbon atoms in the alkyl, especially 8 to 12 carbon atoms in the alkyl, while the number of ethoxy units in the molecule amounts to 5 to 15 and the proportion of the number of carbon atoms in the hydrocarbon residue to the number of alkylene glycol groups amounts to 4:1 to 1:1.

Further suitable nonionic surface active agents are the polyoxyethylene glycol ether derivatives of secondary alkanols having 10 to 24 carbon atoms, alkylamines having 10 to 24 carbon atoms, higher fatty acids, higher fatty acid amides, partial ethers and partial esters of lower alkane-polyols, for example of glycerol or pentitols, hexitols and sugar alcohols, with higher fatty acids or alkenols having 10 to 24 carbon atoms, as well as alkyl mercaptans and sulfamides, in which case the number of the carbon atoms contained in the hydrocarbon residue, the number of ethoxy units and the proportion of the number of carbon atoms to the number of alkoxy units are the same as in the case of the ethoxylated alcohols and alkylphenols.

Furthermore, polyoxyalkylene glycol ether derivatives are suitable which contain ethylene glycol ether groups, propylene glycol ether groups, and/or butylene glycol ether groups and which are obtainable, for example, by addition of propylene oxide or butylene oxide or both to the abovementioned ethoxylated derivatives. Such compounds contain usually 10 to 30 ethoxy units and 5 to 20 propoxy and/or butoxy units and are marked by a very low foam formation. Similar properties are possessed by the propoxylated polyoxyethylene glycols and ethylenediaminopolyoxyethylene glycols with 20 to 250 ethoxy units and 10 to 100 propoxy units, known by the trade marks "Pluronic" and "Tetronic".

Mixtures of glycol ether derivatives of different structure and different degrees of alkoxylation or those of the same structure and different degrees of alkoxylation can be used. Preferably, however, the turbidity or cloud point of the polyoxyalkylene glycol ether derivatives or their mixtures should be over 20°C, especially over 30°C.

The impregnation of the textile structures may be effected by contacting this structure with an aqueous solution of the surface-active agents such as by immersing them in this aqueous solution of the surface active agents or spraying them therewith. In order to aid in the adsorption of the surface active agents onto the surface of the textile, the solution should have a pH value in the acid range of 6 or less, preferably less than 5.2, for example 2 to 5. Whenever the impregnation takes place in the acid form at a pH of 6 or less, the impregnation temperature is preferably below the turbidity point, but no higher than the turbidity point.

The acidification of the solution may be carried out in the usual way with inorganic or organic acids, for example hydrochloric acid, sulfuric acid, phosphoric acid, nitric acid, formic acid, acetic acid, oxalic acid, succinic acid, tartaric acid, lactic acid or citric acid. The use of acid salts, for example alkali metal hydrogen sulfate, such as sodium or potassium hydrogen sulfate, or alkali metal dihydrogen phosphates, such as sodium or potassium dihydrogen phosphate as well as acid buffer solutions, for example citric acid-phosphate mixtures, is also possible.

The amount of surface active agent present in the solution amounts to 0.1 to 30% preferably 0.2 to 10% by weight. A previously utilized solution may be used again, provided the adsorbed surface active agent is replaced. The adsorption time should be at least 5 minutes. The adsorption is ended after 10 to 90 minutes, depending on the concentration of the solution, and a longer contact time of the solution is therefore unnecessary. The amount of surface active agent introduced in this manner is from 0.05 to 20%, preferably 0.5 to 10% by weight, based upon the textile material.

The textile structures may be impregnated in addition with further adjuvant substances customarily used in washing and cleaning compositions, for example with perfumes and bactericides or bacteriostatic substances, such as halogenated phenol ethers and thioethers, halogenated carbanilides and salicylanilides, and halogenated diphenyl methane. These may be introduced together with the surface active agents or separately, for example, by spraying.

The textile structures after the impregnation are freed of excess liquid by being allowed to drain, by squeezing out or by centrifuging the textile and by being dried, possibly with retention of a certain amount of residual moisture.

The advantages of the cleaning cloths impregnated in the manner according to the invention include possessing a high cleaning power. In addition the adsorbed surface-active agent is only gradually lost during the application, so that no smearing of the treated surfaces with excess agent occurs; but on the other hand even after repeated use, for example after 20 or more cleaning operations, there are still sufficient amounts thereof present. Because of the high content of carboxyl groups in the fibrous structure, which act as ion exchangers, lime-containing impurities are sequestered, and bound to the fibrous structure or the water used for the cleaning is substantially softened. Due to this water softening effect the cleaning process is helped and the formation of a lime fog, which is noticeably annoying, especially on window panes and mirror glass, is prevented without an intensive subsequent rubbing and polishing being necessary. Apart from this, the cleaning cloths have a pleasant handle, which is an advantageous difference from the impregnated cleaning pads previously used.

The following examples are merely illustrative of the present invention without being deemed limitative in any manner thereof.

EXAMPLES

I. Production Of The Textile Materials

A. Woven Fabric From Cellulose Graft Polymer (Sample A)

17.2 gm of reinforced cotton fabric were prepared as square pieces (side length 10 cm) and placed in a solution of 5 gm of sodium hydroxide and 15 gm of sodium chloroacetate in 160 gm of water. After 15 minutes, the fabric pieces were removed, allowed to drip dry, and then heated for 4 hours at 70°C. The carboxymethylated fabrics were treated with diluted aqueous hydrochloric acid, washed acid-free with water and reacted for 30 minutes with stirring in a solution of 13.3 gm of iron (II)-ammonium sulfate $.6H_2O$ in 3400 gm of water to convert the carboxymethyl groups into the corresponding iron salts.

After the fabric pieces were washed with water, they were suspended in 1.7 liters of water in a 3-liter surface-ground flask which was provided with a stirrer, reflux condenser, thermometer and dropping funnel. Thereafter 129 gm of methyl acrylate were added. Then a solution of 1.1 gm of a 30% aqueous hydrogen peroxide in 10 gm of water was added dropwise over a period of 10 minutes at room temperature. Subsequently, the contents of the flask were heated to 60°C and stirred for 1 hour at this temperature.

The graft-polymerized fabric pieces were treated with dilute sulfuric acid to dissolve out the iron ions, washed until neutral with water, and reacted for 3 hours under stirring at the reflux temperature with a solution of 60 gm of sodium hydroxide in 1 liter of a mixture of 60% by weight of methanol and 40% by weight of water in order to saponify the ester-groups of the grafted side chains. After repeated washing with aqueous methanol of the same concentration, draining with pure methanol and drying at 70°C, 110 gm of exchanger fabric were obtained.

A weighed sample of the fabric was treated with 0.1N HCl, washed acid-free with distilled water, and titrated with 0.1N NaOH against phenolphthalein as an indicator. The capacity of the exchanger was 10 mVal/gm.

A second sample was introduced into a neutral aqueous solution of 100 mg of calcium chloride in 1 liter of water, and the solution was stirred for 15 minutes. The decrease of the calcium-ion concentration in the solution was determined by titration with a "Komplexon" solution which gave a calcium binding capacity of 150 mg of $Ca^{2+}$ per gram of fabric.

B. Fleece From A Vinyl Copolymerizate (Sample B)

210 gm of acrylic acid were dissolved in 3 liters of water and, after addition of 14 gm of an aqueous 40% by weight solution of sulfonated castor oil, a mixture of 80 gm of 1,4-butanediol diacrylate and 3.5 gm of benzoin methyl ether was added and emulsified. Then 150 gm of an aqueous 40% dispersion of a previously formed copolymerizate comprising 85% of n-butyl acrylate, 7% of acrylic acid, 5% of N-methylol acrylamide and 3% of 1,4-butanediol diacrylate were added. 210 gm of a needle-felted polypropylene fleece with a unit surface weight of about 100 gm/m² was saturated with the mixture. The mass was placed on a metal surface cooled to −15°C, which was covered with a layer 0.3 mm in thickness of a solution, solidified to a fine crystalline state, of 5 parts of an addition product of 40 mols of ethylene oxide to castor oil in 95 parts of water. The saturated mass became crystalline at −15° C upon solidifying. Then it was irradiated for 10 minutes at a distance of 25 cm with Philips-black light lamps of type TL 40 W/0.8. The solidified irradiated structure was thawed, washed with water and dried at 60°C in a current of air. The fleece obtained had a total capacity in carboxyl groups of 5.3 mVal/gm. The carboxyl groups were converted into carboxylate groups by a treatment with excess 6% sodium hydroxide solution for 15 minutes at 25°C. After washing out with distilled water the fleece was dried. The calcium binding power amounted to 73 mgm CaO/gm according to the above indicated method of determination.

II. Impregnation

The textile structures A and B were placed in a 6% by weight aqueous solution of n-nonylphenol-octaoxyethylene glycol ether (turbidity point 38°C). The pH value was adjusted to 4.5 by addition of hydrochloric acid and maintained at this value during the treatment. The temperature of the solution was maintained at 22°C. 1 liter of solution was utilized for 50 gm of textile material. The textile samples were stirred mechanically during a residence time of 1 hour. Then the samples were taken out of the solution, centrifuged in a washing centrifuge and dried at room temperature.

Samples of leather for comparison (so-called "chamois leather") and cotton cloth (dust cloth) were treated in the same manner.

III. Technical Application Examination

To examine the adsorption behavior, the textile samples were rinsed in a domestic washing machine with a rotating drum with water at 50°C for 6 minutes each time; in each case 20 liters of rinsing water were used per 100 gm of textile material. The surface tension of the waste rinsing water was determined by the dipping ring method.

The results are reported below in the following Table:

TABLE

| Example | Textile material | Surface tension in dyne/cm after 1 rinsing operations | 3 | 5 | 10 | 20 |
|---|---|---|---|---|---|---|
| 1 | Sample A | 31 | 32 | 33 | 35 | 44 |
| 2 | Sample B | 31 | 32 | 33 | 33 | 40 |
| — | Leather | 31 | 35 | 55 | 70 | — |

TABLE-continued

| Example | Textile material | Surface tension in dyne/cm after 1 | 3 | 5 | 10 | 20 |
|---|---|---|---|---|---|---|
| | | rinsing operations | | | | |
| — | Cotton cloth | 31 | 34 | 50 | 70 | — |

The results show that the surface-active agents in the textiles treated according to the invention were only lost, very slowly, and that even after 20 rinsings, sufficient quantities thereof were still found on the cleaning cloth. In contrast to this, the supply of surface-active agent in the leather and cotton pieces was already mostly used up after 5 rinsing.

In practical application (cleaning of mirror glass contaminated with skin fat and lime soap splashes) the cleaning cloths of Samples A and B have proved superior in their cleaning action to the comparative samples. In the case of the comparative samples, after five times in use and subsequent washing out with water at 18° German hardness, a satisfactory cleaning result was no longer obtained. With the samples according to the invention, in the same frequency of use, the mirror glass panes could still be cleaned satisfactorily without streaks and drop formation even after 20 times in use.

EXAMPLES 3 and 4

Utilizing a procedure analogous to that described above, the textile samples were impregnated with a fatty alcohol ethoxylate, which had been obtained by reaction of a fatty alcohol mixture having 16 to 18 carbon atoms and an iodine value of 45, with 7.5 mols of ethylene oxide and which had a turbidity point of 50°C. The concentration of the solution amounted to 3% by weight. The temperature was 25°C. The pH value was 4 to 5, and the residence time was 45 minutes. The impregnated cloths had the same properties upon the use thereof as those according to Examples 1 and 2. After 10 rinsings with water of 50°C, the surface tension of the rinsing liquid rose from 33 to 45 dyne/cm for Sample A and from 33 to 40 dyne/cm for Sample B. Moreover, even after 20 rinsings, detectable amounts of surface-active agent were still present according to the invention. Comparative samples of leather and cotton treated in the same way were practically free from surface-active material after 7 rinsings.

All the cleaning cloths according to the invention had a comparatively pleasant hand.

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

I claim:

1. A textile fibrous structure impregnated with a nonionic surface-active agent and suitable for cleaning purposes comprising a water-insoluble textile fibrous structure having a content of salt-forming carboxyl groups in such an amount that there is at least 1 mVal of said salt-forming carboxyl groups per gram of said structure, and said carboxyl groups being present substantially as free carboxyl groups; said structure containing from 0.05 to 20% of its weight of an impregnant comprising at least one water-soluble nonionic polyalkoxylated surface-active agent having a turbidity point above 20°C.

2. The textile fibrous structure of claim 1, in which the alkoxy units of said water-soluble nonionic polyalkoxylated surface-active agent contain from 2 to 4 carbon atoms.

3. The textile fibrous structure of claim 1, in which, the proportion of carbon atoms in the hydrocarbon moiety of said agent to the number of alkoxy units in said agent is from 4:1 to 1:1.

4. The textile fibrous structure of claim 1, in which said agent is a polyethoxylated agent.

5. The textile fibrous structure of claim 1, in which there are 2 mVal of said salt-forming carboxyl groups per gram of said structure.

6. The textile fibrous structure of claim 1, in which the turbidity point of said nonionic polyalkoxylated surface-active agent lies above 35°C.

7. The textile fibrous structure of claim 1, in which said nonionic polyalkoxylated surface-active agent is an ethoxylated primary fatty alcohol containing 10 to 24 carbon atoms and 5 to 15 ethoxy units.

8. The textile fibrous structure of claim 7, in which said fatty alcohol contains 12 to 20 carbon atoms.

9. The textile fibrous structure of claim 1, in which said agent is an ethoxylated phenol carrying a straight-chain alkyl substituent containing 6 to 15 carbon atoms, said ethoxylated phenol containing 5 to 15 ethoxy units.

10. The textile fibrous structure of claim 9, in which said substituent contains 8 to 12 carbon atoms.

11. The textile fibrous structure of claim 1, in which said impregnant comprises from 0.5 to 10% by weight of said structure.

12. A process for the impregnation of textile fibrous structures comprising contacting an insoluble textile fibrous structure having a content of at least 1 mVal of free salt-forming carboxyl groups per gram of said structure with an aqueous solution containing from 0.1 to 30% by weight of a water-soluble nonionic polyalkoxylated surface-active agent the turbidity point of which lies above 20°C, the pH of said solution being 6 or lower, for at least 5 minutes at a temperature no higher than the turbidity point of said agent, and recovering said impregnated textile fibrous structure.

13. The process of claim 12, in which said pH of said solution is from 2 to 5.

14. The process of claim 12, in which the concentration of said nonionic polyalkoxylated surface active agent in said solution is from 0.2 to 10% by weight of said solution.

15. The process of claim 12, in which said contacting comprises immersing said structure into a bath containing said aqueous solution.

16. The process of claim 12, in which said contacting comprises spraying said structure with said aqueous solution.

17. The process of claim 12, in which said impregnation temperature is below the turbidity point of said agent.

18. The process for cleaning or polishing a surface comprising wiping said surface with the impregnated textile fibrous structure of claim 1.

19. A process according to claim 12 wherein the recovered impregnated textile fibrous structure is dried.

* * * * *